US005638549A

United States Patent [19]

Thomas

[11] Patent Number: 5,638,549

[45] Date of Patent: Jun. 17, 1997

[54] CHANGE-SAFE POCKET

[75] Inventor: Piers M. Thomas, Ventura, Calif.

[73] Assignee: Patagonia, Inc., Ventura, Calif.

[21] Appl. No.: 606,642

[22] Filed: Feb. 27, 1996

[51] Int. Cl.[6] ..... A41D 27/20

[52] U.S. Cl. ..... 2/247; 2/250; 2/254

[58] Field of Search ..... 2/254, 253, 250, 2/247

[56] References Cited

U.S. PATENT DOCUMENTS

| | | | |
|---|---|---|---|
| 1,075,240 | 10/1913 | Barrett | 2/254 |
| 1,122,636 | 12/1914 | Prendergast | 2/254 |
| 1,494,067 | 5/1924 | D'Iorio | 2/254 |
| 1,850,827 | 3/1932 | Charles | 2/254 |
| 1,942,410 | 1/1934 | Charles | 2/254 |
| 2,236,694 | 3/1941 | Oppenheimer | 2/247 |
| 2,416,343 | 2/1947 | Oppenheimer | 2/253 |
| 2,557,366 | 6/1951 | Wennerstrom | 2/254 |
| 3,077,604 | 2/1963 | Colangelo | 2/253 X |

*Primary Examiner*—Amy B. Vanatta
*Assistant Examiner*—Shirra L. Jenkins
*Attorney, Agent, or Firm*—Blakely, Sokoloff, Taylor & Zafman LLP

[57] ABSTRACT

A safety pocket for a garment. In one embodiment the pocket includes two compartments: a front compartment and a rear compartment. The front compartment has a pocket opening that allows the wearer to deposit articles into the pocket. While the wearer is standing, the articles placed into the pocket remain in the front compartment. An opening or passage is provided along the bottom of the front and rear pocket compartments to permit articles placed within the front compartment to pass into the rear compartment as the wearer sits down, leans or rolls backward.

2 Claims, 13 Drawing Sheets

CHANGE-SAFE POCKET

FIELD OF THE INVENTION

The present invention pertains to the field of wearing apparels. More specifically, the invention relates to an improved pocket that prevents coins and other articles from rolling out of the pocket during the action of sitting, leaning or rolling backward.

BACKGROUND OF THE INVENTION

For years, men, women and children have experienced the misfortune of losing money and other objects stored within their pockets. In many instances, the loss occurs as the person wearing the garment transitions from a standing position to a sitting position or leans or rolls backward. During this movement, coins and other objects tend to roll out of the pocket onto the chair, car seat, ground, or other places surrounding the unsuspecting wearer.

FIG. 1 illustrates a left-side view of a typical pair of pants 10 having a waistband 11 and a front pocket 12. As shown, pant 10 typically includes a waistband 11, a front panel 16 and a back panel 18. Front and back panels 16 and 18 are generally joined at a side seam 20 that extends downward along the leg of the pant. For ease of access, the pocket opening 14 is generally located either along or in front of side seam 20. Note that the back of pocket 12 generally terminates at a back edge 24 along side seam 20. Coins 22, or other articles that are placed into the pocket, naturally .fall to the bottom of the pocket while the wearer is in a standing position. However, when the wearer moves to a sitting position the coins located within the pocket tend to fall back along the back edge 24 and roll out of the pocket through opening 14.

FIG. 2 illustrates a prior art pair of pants 30 having a pocket 33 that includes a "stop" 32. Stop 32 is stitched into pocket 33 below the pocket opening 34 to prevent coins from rolling out of the pocket. When a wearer moves from a standing to a sitting position. As illustrated in FIG. 2, pant 30 includes a waistband 31, a front panel 36 and a back panel 38. Front and back panels 36 and 38 are joined at a side seam 37 that extends downward along the leg of the pant. Pocket opening 34 is located adjacent to and in front of side seam 37. When a coin 39 is placed into the pocket while the wearer is standing, the coin falls to the bottom of the pocket at a low point located along side seam 37 and below stop 32. Although the pocket 30 of FIG. 2 offers some protection against the loss of coins during the act of sitting, it has many drawbacks. For example, if the size of the coin or article placed into the pocket has a width or diameter that is greater than the width of stop 32, the coin or article tends to roll over stop 32 and out of the pocket through opening 34. If a number of smaller coins and/or articles are stored within the pocket the same result occurs since the coins and other articles tend to piggyback themselves over stop 32 and out of opening 34 during the motion of sitting. As mentioned earlier, coins and/or other objects that are placed into pocket 30 fall to the bottom of the pocket below stop 32 when the wearer is in a standing position. As a consequence, it is difficult to retrieve articles located beneath stop 32 even while the wearer is in a standing position. In many instances, the stitched stop 32 may also detract from the outward appearance of the garment.

What is needed then is a pocket that protects against the spilling of articles from the pocket while providing easy access to the contents of the pocket. In addition, the pocket should not detract from the outward appearance of the garment nor interfere with the natural wear and feel of the garment.

SUMMARY OF THE INVENTION

The present invention provides a safety pocket in a pair of pants, shorts, dress, skirt, jacket, shirt, etc., that prevents coins and other objects from spilling out of the pocket when the wearer of the garment sits down, leans or rolls backward.

In one embodiment of the present invention the pocket includes two compartments: a front compartment and a rear compartment. The front compartment has a pocket opening that allows the wearer to deposit articles into the pocket. While the wearer is standing, the articles placed into the pocket remain in the front compartment. An opening or passage is provided along the bottom of the front and rear pocket compartments to permit articles placed within the front compartment to pass into the rear compartment as the wearer sits down, leans or rolls backward.

BRIEF DESCRIPTION OF THE DRAWINGS

The present invention is illustrated by way of example and is not limited by the figures of the accompanying drawings, in which like references indicate similar elements, and in which.

DETAILED DESCRIPTION

As will be described in detail below, the present invention provides a pocket in a garment that prevents coins and other articles from spilling out of the pocket during the action of sitting, leaning or rolling backward.

Figure 1:
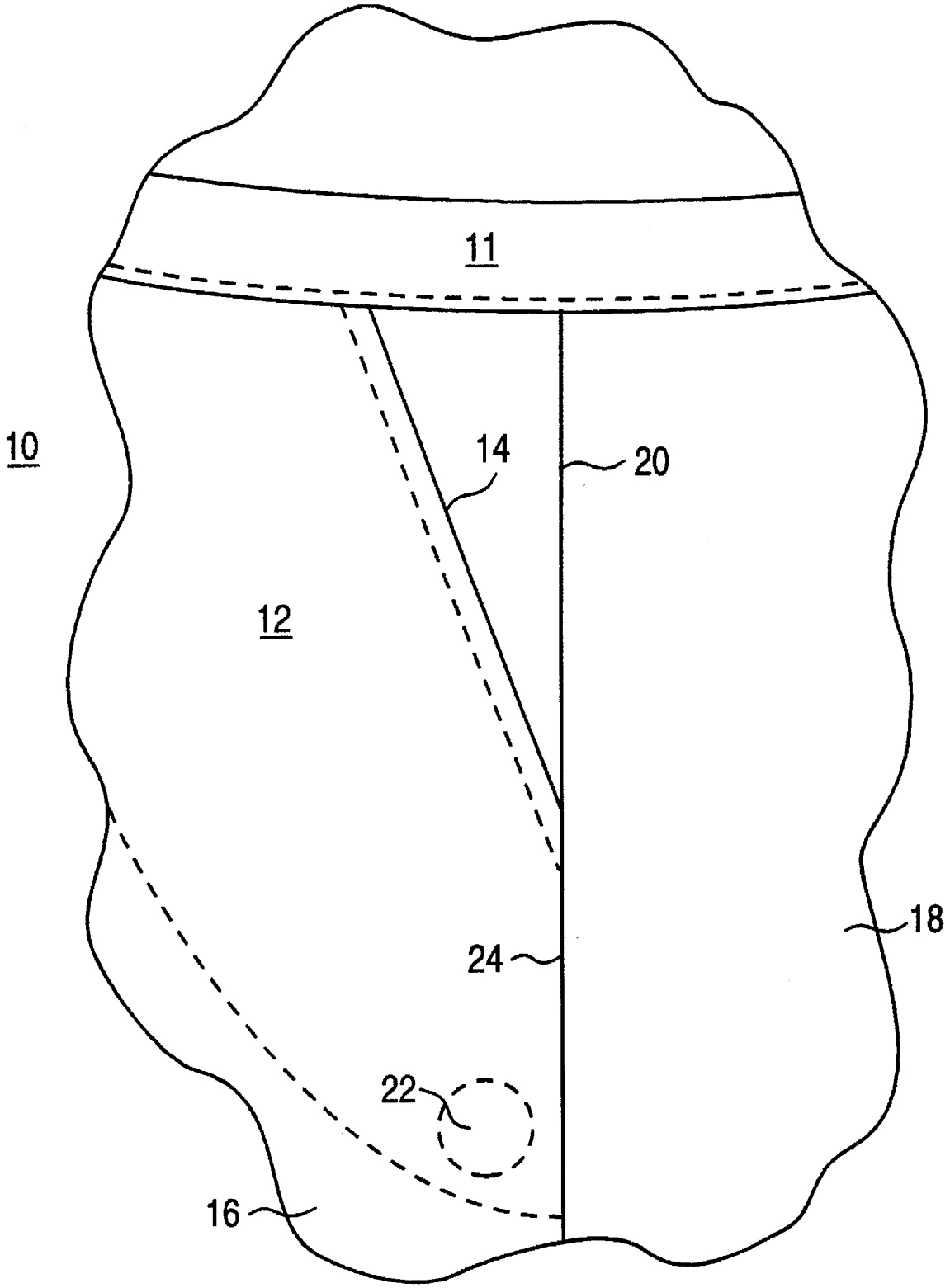
FIG. 1 (Prior Art)
FIG. 1 illustrates a side view of a conventional prior art pocket.
Figure 2:
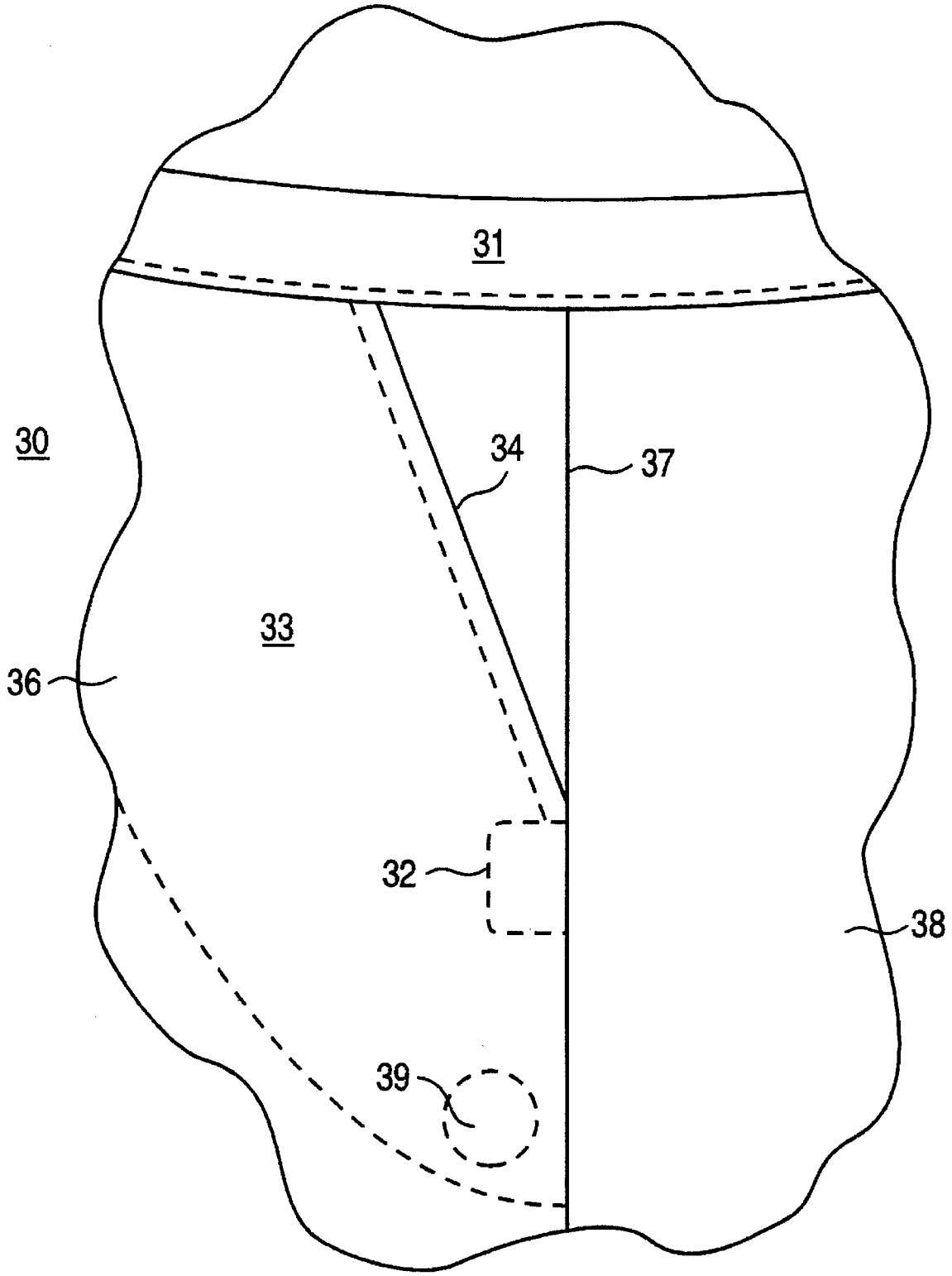
FIG. 2 (Prior Art)
FIG. 2 illustrates a side view of a prior art pocket having a coin stop.
Figure 3A:
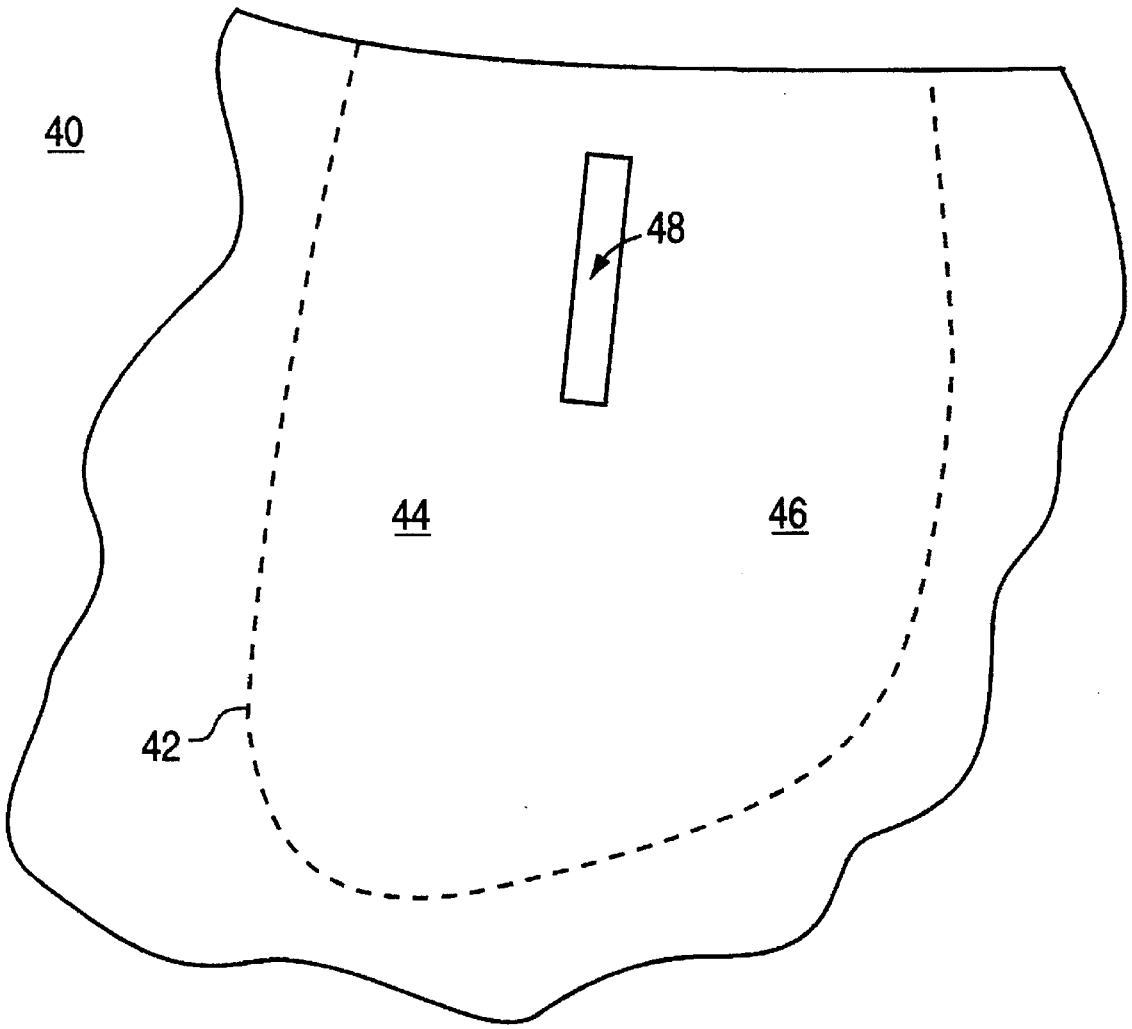
FIG. 3A illustrates a side view of a pocket in one embodiment of the present invention.
Figure 3B:
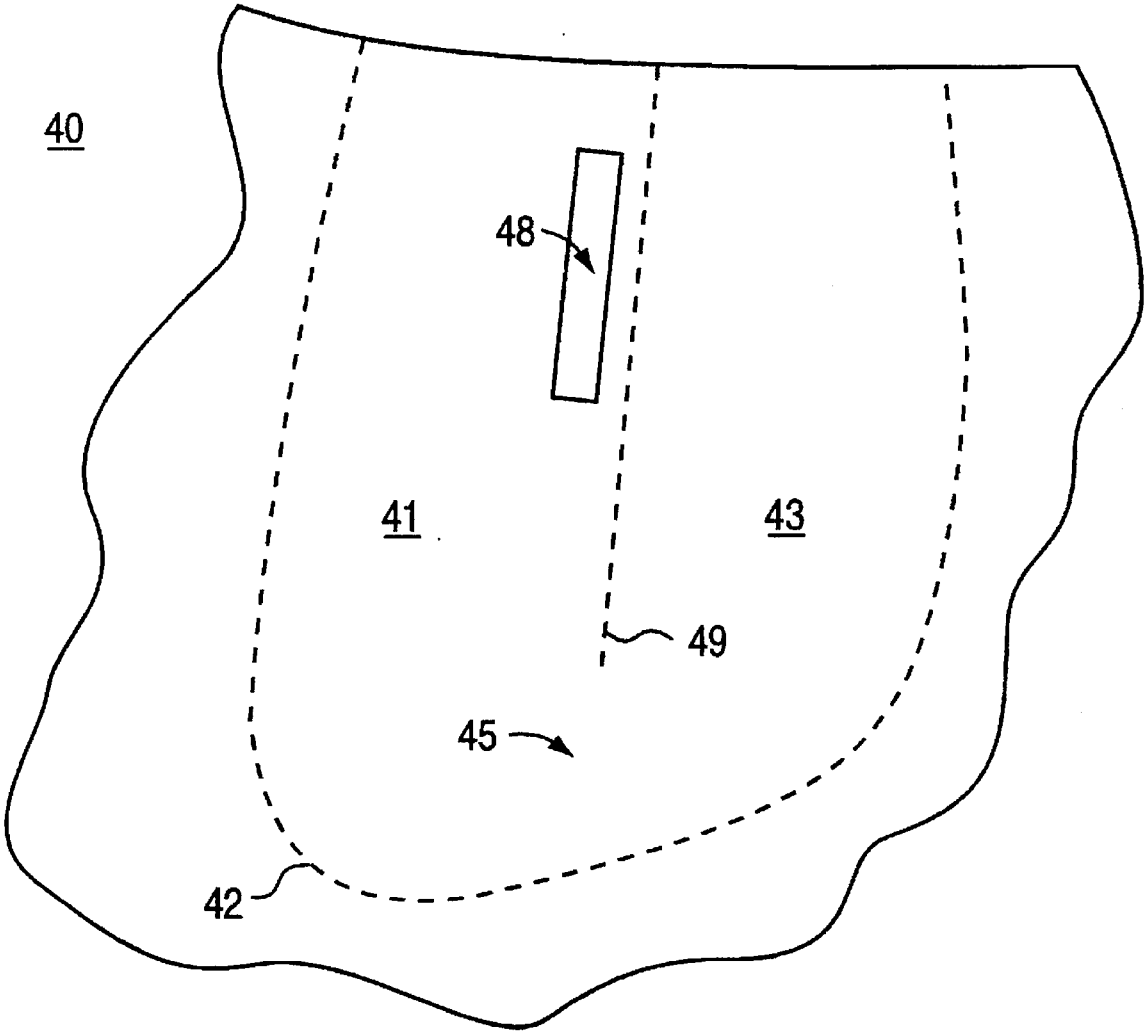
FIG. 3B illustrates the pocket of FIG. 3A pocket having front and rear compartments.

FIG. 3A illustrates a left-side view of a pocket 42 in a pant leg 40. Pocket 42 has a front section 44, a rear section 46 and a pocket opening 48. In one embodiment, pocket opening 48 may comprise a slit that is cut within pant leg 40. The pocket opening allows the wearer to deposit coins or other articles into the pocket cavity. Pocket opening 48 is positioned such that at least a portion of the back section 46 of the pocket cavity is located below and behind the pocket opening. In this configuration, the articles within the pocket will move to the back section 46 of the pocket as the wearer sits down or rolls backward instead of spilling from the pocket opening. As shown in FIG. 3B, pocket 42 may include barrier 49 that divides the pocket into front and rear compartments 41 and 43, receptively. In one embodiment, barrier 49 extends from the top of pocket 42 to a point above the bottom of the pocket. In this manner a passage 45 exists between compartments 41 and 43 to permit articles placed within the front compartment to pass into the rear compartment as the wearer sits or rolls backwards. Barrier 49 generally includes a threaded stitching.

Figure 4A:
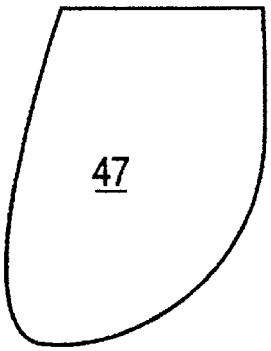
FIG. 4A shows an inner pocket panel that may be used in the construction of the pockets depicted in FIGS. 3A and 3B.
Figure 4B:
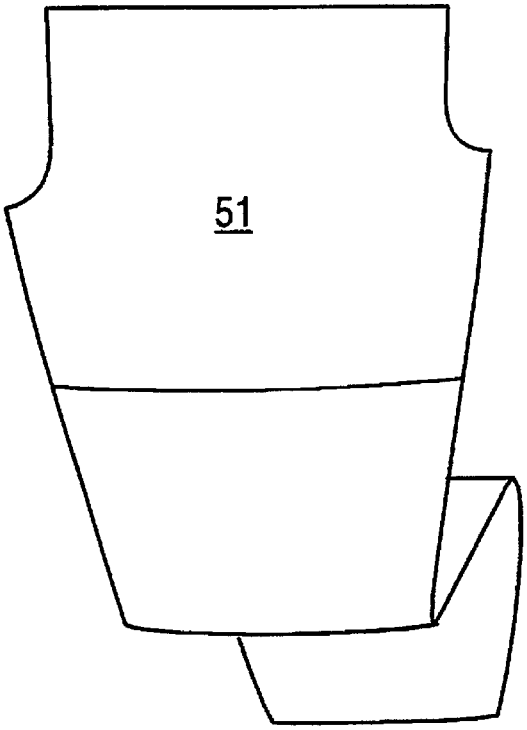
FIG. 4B shows a leg panel that may be used in the construction of either pocket depicted in FIGS. 3A and 3B.
Figure 4C:
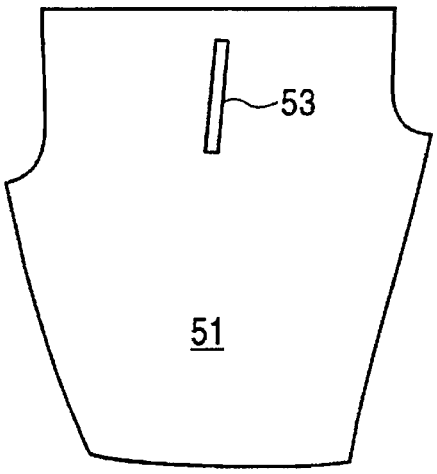
FIGS. 4C–4E show a construction sequence for the pockets depicted in FIGS. 3A and 3B using the panels of FIGS. 4A and 4B.
Figure 4D:
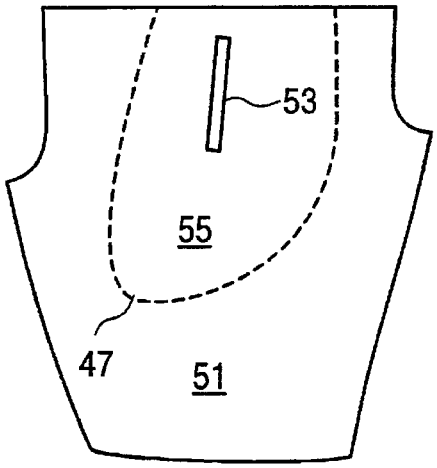
Figure 4E:
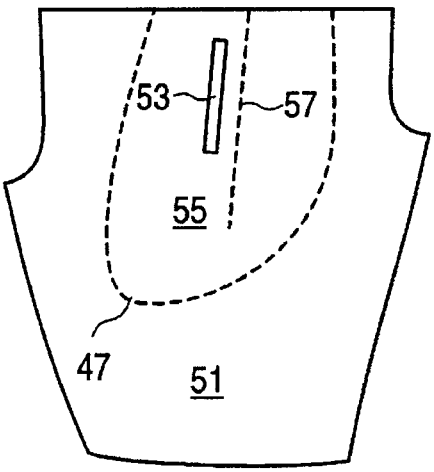

Pocket 42 of FIG. 3A may be constructed in a variety of ways. One method includes the use of an inner pocket panel 47 and a leg panel 51. (See FIGS. 4A and 4B.) To construct the pocket, a slit 53 may be cut into panel 51 to produce a pocket opening. (See FIG. 4C.) Panel 47 is then attached to panel 51 along its outer edges to create an enclosed pocket cavity 55. (See FIG. 4D.) The pocket of FIG. 3B may be formed with an additional stitching step wherein thread 57 is sewn through pocket cavity 55 from the top of pocket to a point above the bottom of the pocket cavity. (See FIG. 4E.)

Figure 5:
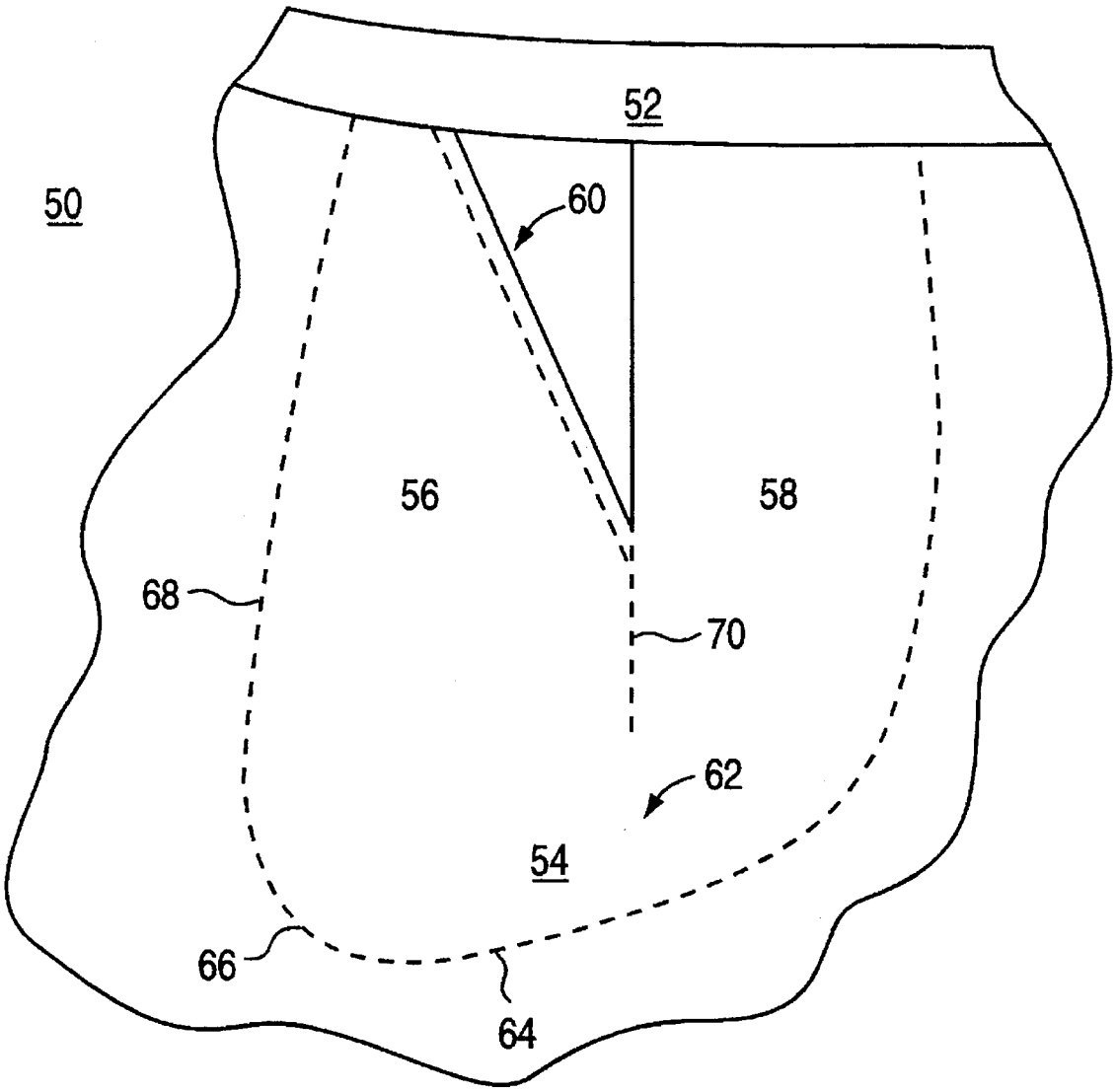
FIG. 5 illustrates a side view of a pocket in another embodiment of the present invention.

FIG. 5 illustrates another embodiment of the pocket of the present invention within a garment 50 that is secured at the waist by a waistband 52. Although the pocket depicted in FIG. 5 is shown attached to a garment worn below the waist, it is appreciated that the pocket may be used in an upper body garment, such as, for example, a jacket or shirt. Turning again to FIG. 5, garment 50 is shown having a pocket 54. Pocket 54 is divided into two compartments: a front compartment 56 and a smaller, rear compartment 58. Compartment 56 has a pocket opening 60 that allows the wearer to deposit coins and other articles into the pocket. In the embodiment of FIG. 5, a curved, bottom edge 64 extends from the rear compartment 58 to a low point 66 at the front edge 68 of compartment 56. Hence, as the wearer of garment 50 stands, the force of gravity keeps the articles within pocket 54 in compartment 56 where they are easily accessible. An opening or passage 62 is provided along bottom edge 64 between front and rear compartments 56 and 58. Passage 62 permits articles contained within compartment 56 to pass into compartment 58 when the wearer of garment 50 sits down or rolls backward. The curvature of bottom edge 64 makes it easier for the contents of pocket 54 to roll or move between compartments 56 and 58 as the wearer moves from one position to another. In one embodiment, front and rear compartments 56 and 58 are separated by a threaded stitch 70 extending along the back of pocket opening 60 to a point above the bottom edge of the pocket.

One of the important features of the present invention lies in the placement and orientation of pocket compartments 56 and 58 and pocket opening 60. As shown in FIG. 5, compartment 56 extends downward and forward of opening 60 into garment 50. The shape and depth of compartment 56 provides both security and ease of access to the contents of the pocket while the wearer is standing. Compartment 58 is located behind compartment 56 and extends at least partially behind pocket opening 60. Therefore, in accordance with the present invention, as the wearer sits or rolls backward, the contents of pocket 54 fall back through passage 62 into compartment 58 rather than spilling out of the pocket opening. It is important to note that the contents of the pocket will be prohibited from spilling from the pocket even when the wearer rotates backward into an upside down position.

It is to be understood that the size and shape of compartments 56 and 58 and opening 60 may vary substantially without deviating from the spirit or scope of the present invention. For example, in lieu of the pocket opening shown in FIG. 5, a pocket opening extending substantially along the edge of waistband 52 may also be used. In addition, although front compartment 56 has been described as being larger than rear compartment 58, it is appreciated that compartment 58 may be of the same size or even larger than compartment 56. In the implementation of the present invention, it is only important that compartments 56 and 58 and pocket opening 60 be oriented in such a way that the contents of pocket 54 pass into compartment 58 rather than spill from opening 60 when the wearer sits down or rolls backward. Furthermore, it is appreciated that garment 50 may comprise a pair of pants, a pair of shorts, a skirt, a jacket, a shirt or any other type of garment that is used to cover the upper or lower body.

Figure 6A:
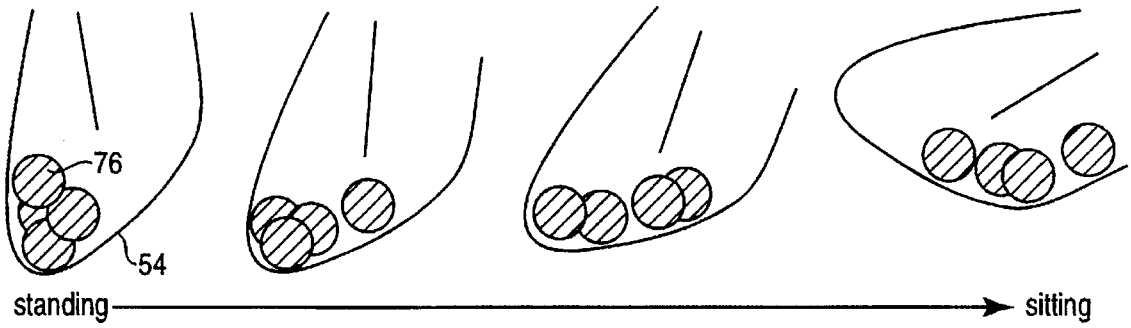
FIG. 6A illustrates the movement of the pocket of FIG. 5 as the wearer moves from a standing position to a sitting position.
Figure 6B:
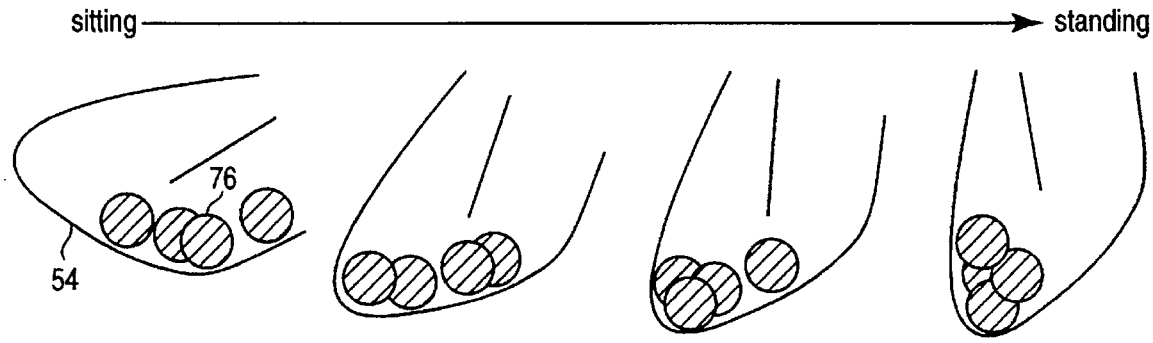
FIG. 6B illustrates the movement of the pocket of FIG. 5 as the wearer moves from a sitting position to a standing position.

FIGS. 6A illustrate the position of pocket 54 and its contents 76 as the wearer of garment 50 moves from a standing position to a sitting position. Conversely, FIG. 6B shows the movement of pocket 54 and its contents 76 as the wearer transitions from a sitting position to a standing position.

In FIG. 5, a hanging pocket is illustrated wherein pocket 54 is attached to garment 50 along the lower edge of waistband 52. It is appreciated, however, that pocket 54 may be attached to garment 50 in a variety of other ways. For example, pocket 54 may be attached to garment 50 along stitch line 70. The pocket may also be attached to the outer garment by a stitching that extends along the outer edges of the pocket.

Figure 7A:
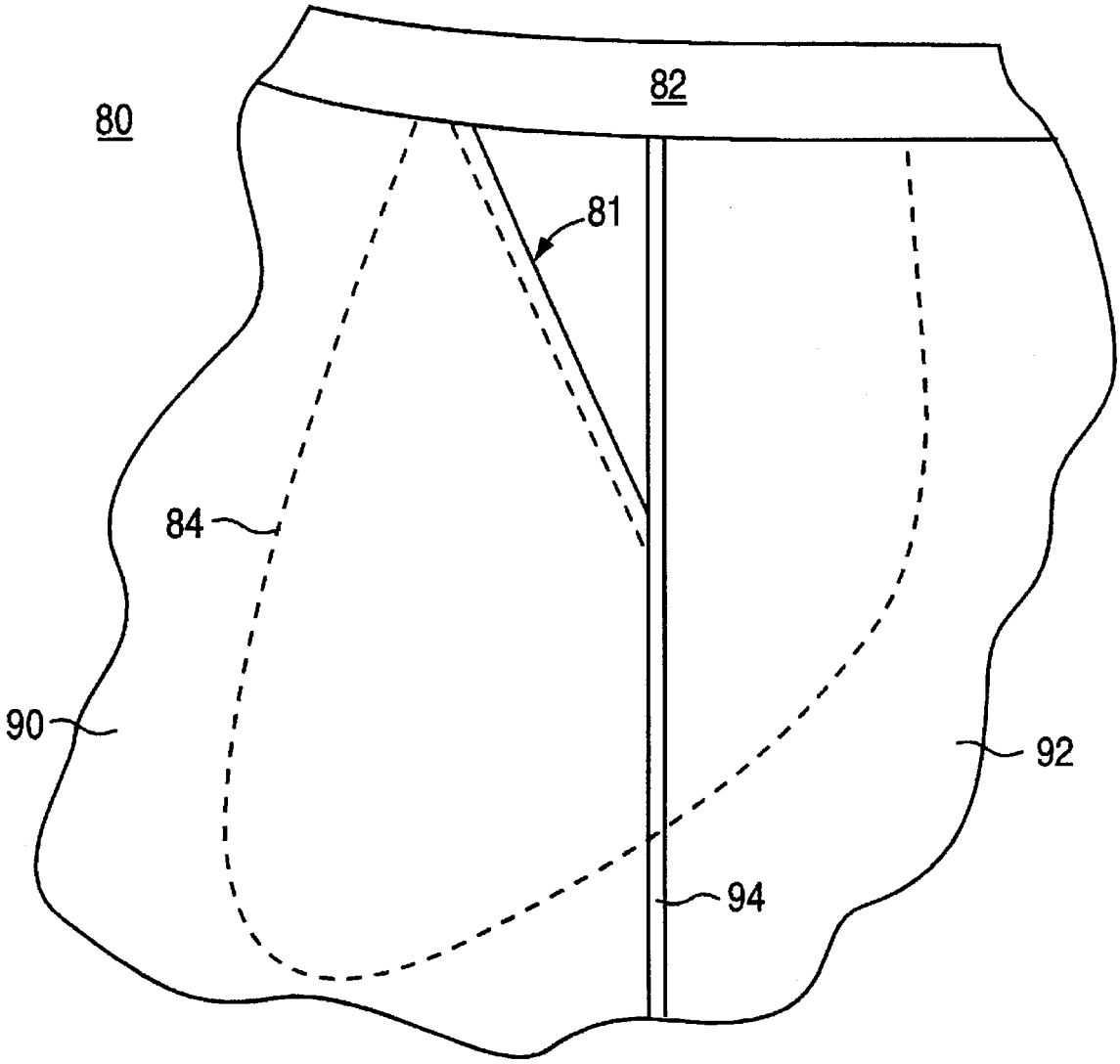
FIG. 7A illustrates another embodiment of the present invention.
Figure 7B:
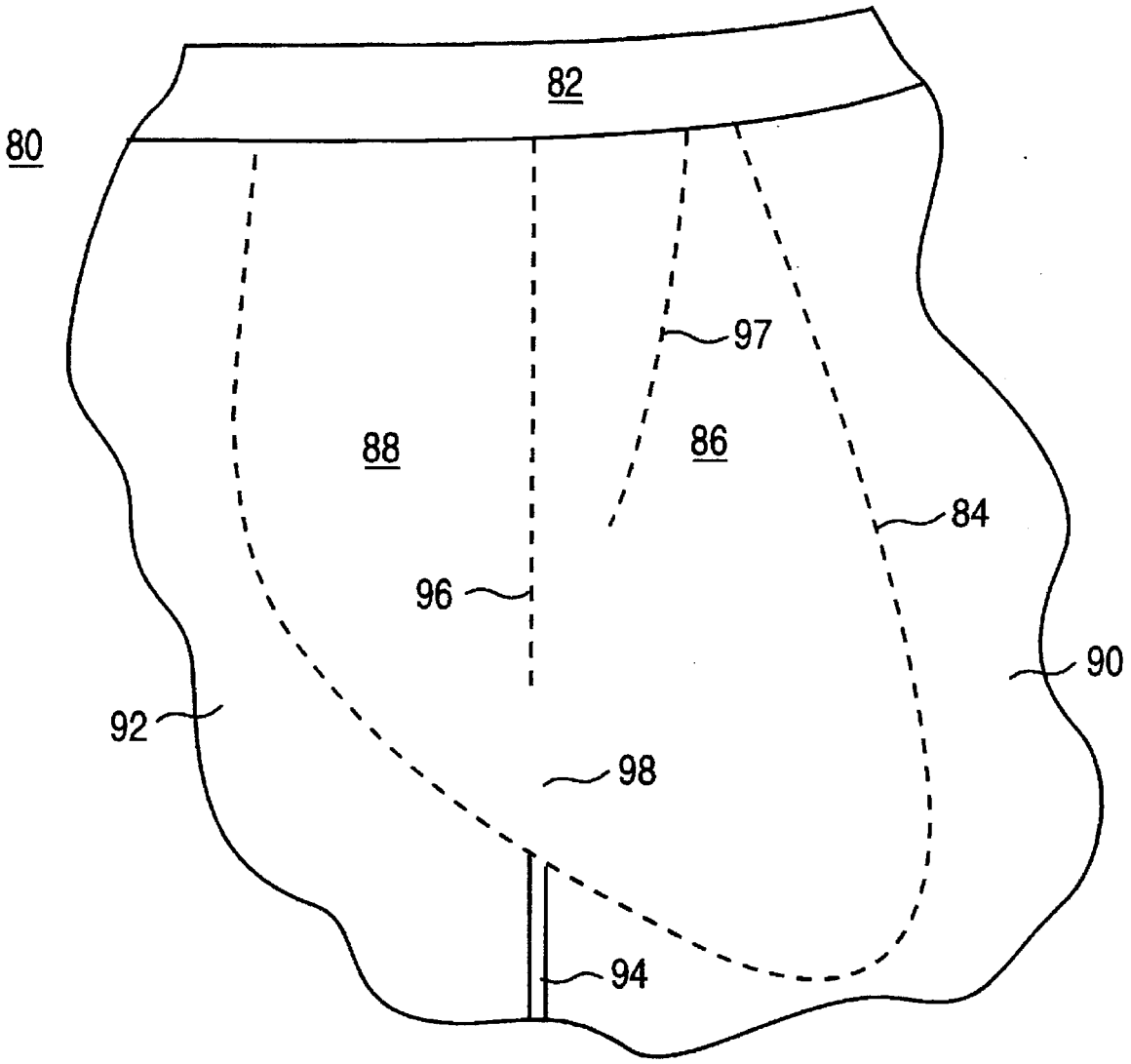
FIG. 7B illustrates an inside view of the pocket depicted in FIG. 7A.

FIG. 7A illustrates another embodiment of the present invention wherein a pocket 84 having an opening 81 is attached to a pair of pants 80 having a waistband 82. Pants 80 include a front panel 90 and a back panel 92 that are joined at a side seam 94 that extends downward along the leg of the pant. FIG. 7B shows an inside view of the pants and pocket illustrated in FIG. 7A. As shown, pocket 84 is divided into two compartments 86 and 88 having an opening or passage 98 that permits articles to pass between the compartments. The function and construction of pocket 84 is similar to the pocket depicted in FIG. 5 except that the inner pocket panel is partially attached to pants 80 along side seam 94 by a threaded stitching 96. The compartmentalization of pocket 84 into compartments 86 and 88 may be made during the attachment of the pocket to side seam 94 or may be made at some other time. For example, in FIG. 7B, compartments 88 and 86 are divided by stitching 97. In one embodiment, pocket 84 may be affixed to the leg of the pant by stitching the outer edges of the pocket to front and back panels 90 and 92.

Figure 8A:
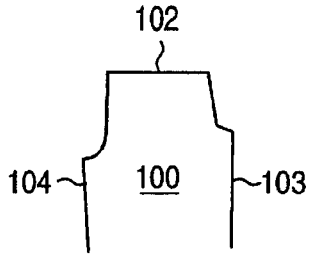
FIGS. 8A–8G illustrate the pattern pieces in one embodiment of the present invention.
Figure 8B:
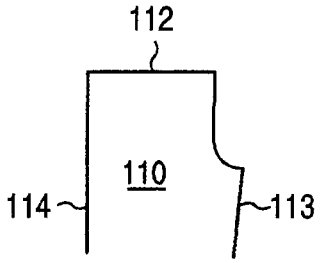
Figure 8C:
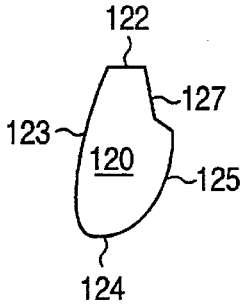
Figure 8D:
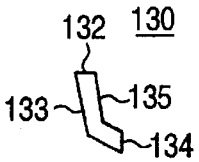
Figure 8E:
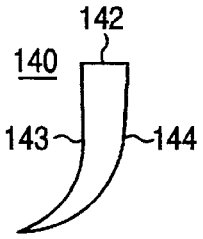
Figure 8F:
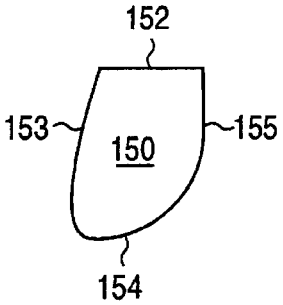
Figure 8G:
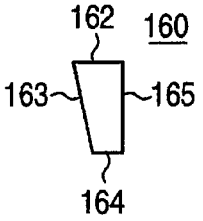

FIGS. 8A through 8G show seven separate panels that may be used to construct a pants pocket of the present invention. FIG. 8A shows a front panel 100 to a pair of pants having a top, back and front edge 102–104, respectively. FIG. 8B shows a back panel 110 having a top, back and front edge 112–114, respectively. FIG. 8C shows an inner pocket panel 120 having a top, front, bottom and back edge 122–125, respectively. Panel 120 also includes a cutout section 127 to accommodate a pocket opening when the pocket is fully constructed. FIG. 8D shows a panel 130 that is used to face the inner side of panel 120 along cutout section 127. Facing 130 typically comprises the same material as front and rear panels 100 and 110 and is used for support and to add to the attractive appearance of the pocket opening. Facing 130 includes top, front, bottom and side edges 132–135, respectively. FIG. 8E shows a crescent shaped panel 140 having a top, front and back edge 142–144, respectively. Panel 140 forms a portion of the inner pocket panel and is used to create a separate rear compartment in the finished pocket. FIG. 8F shows an outer pocket panel 150 having top, front, bottom and back edges 152–155, respectively. FIG. 8G shows a panel 160 having top, front, bottom and back edges 162–165, respectively. Panel 160 typically comprises the same material as front and rear panels 100 and 110. The panel is commonly known as a "pocket extension" and is attached to the upper, exposed portion of inner pocket panel 150. Like facing 130, pocket extension 160 enhances the outward appearance of the pocket opening.

Figure 9A:
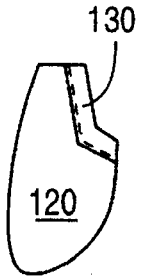
FIGS. 9A–9F illustrate the construction sequence of one embodiment of the present invention utilizing the pattern pieces of FIGS. 8A–8G.
Figure 9B:
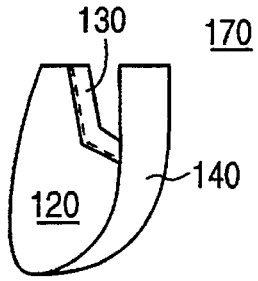
Figure 9C:
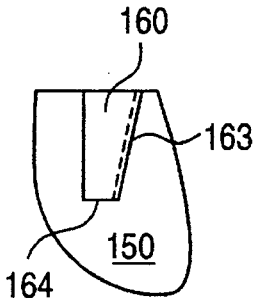
Figure 9D:
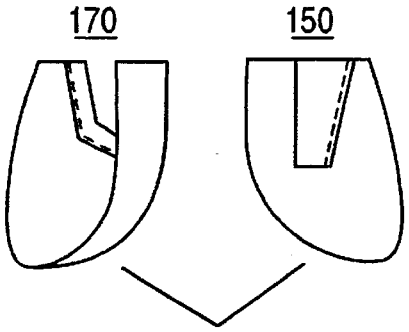
Figure 9E:
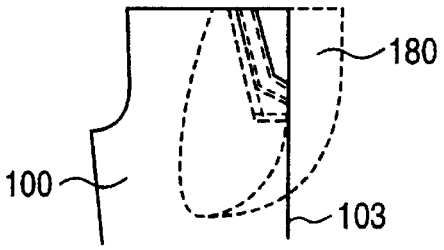
Figure 9F:
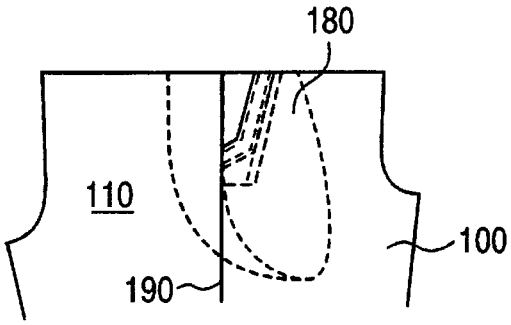

FIGS. 9A–9F illustrate the construction sequence in one embodiment of the present invention using panels 100, 110, 120, 130, 140, 150 and 160. As shown in FIG. 9A, facing 130 is attached to panel 120 along cutout section 127. The front edge 143 is then attached to the back edge 125 of panel 120 forming the complete inner panel 170 of the pocket (See FIG. 9B.). Concurrent with the preceding steps, pocket extension 160 may be set to outer pocket panel 150 by attaching the front edge of the pocket extension to panel 150. (See FIG. 9C.) Once the preceding steps have been completed, the outer panel 170 and inner panel 150 are attached along their front, bottom and back edges to form a pocket bag 180. (See FIG. 9D.) In FIG. 9E the outer pocket panel 170 of pocket bag 180 is attached to front panel 100 by stitching the back edge 134 of facing 130 to the panel as shown. In the step of FIG. 9F, pocket bag 180 is attached to panels 100 and 110 at a side seam 190. In one embodiment side seam 190 is formed during the attachment of pocket bag 180 to panels 100 and 110. The attachment of pocket bag 180 to panels 100 and 110 is made by folding the pocket bag along the back edge 103 of panel 100 and sewing all of the panel layers together along the folded edge. The top of the pocket bag can be attached to the waistband of the garment at some later time.

It is to be understood that the construction sequence just described is only one method of constructing and attaching a pocket of the present invention to a garment. For example, the use of a pocket facing and a pocket extension is not necessary in the implementation of the invention. Moreover, an outer pocket panel comprising a single panel construction may be used instead of the multi-panel construction described.

Figure 10:
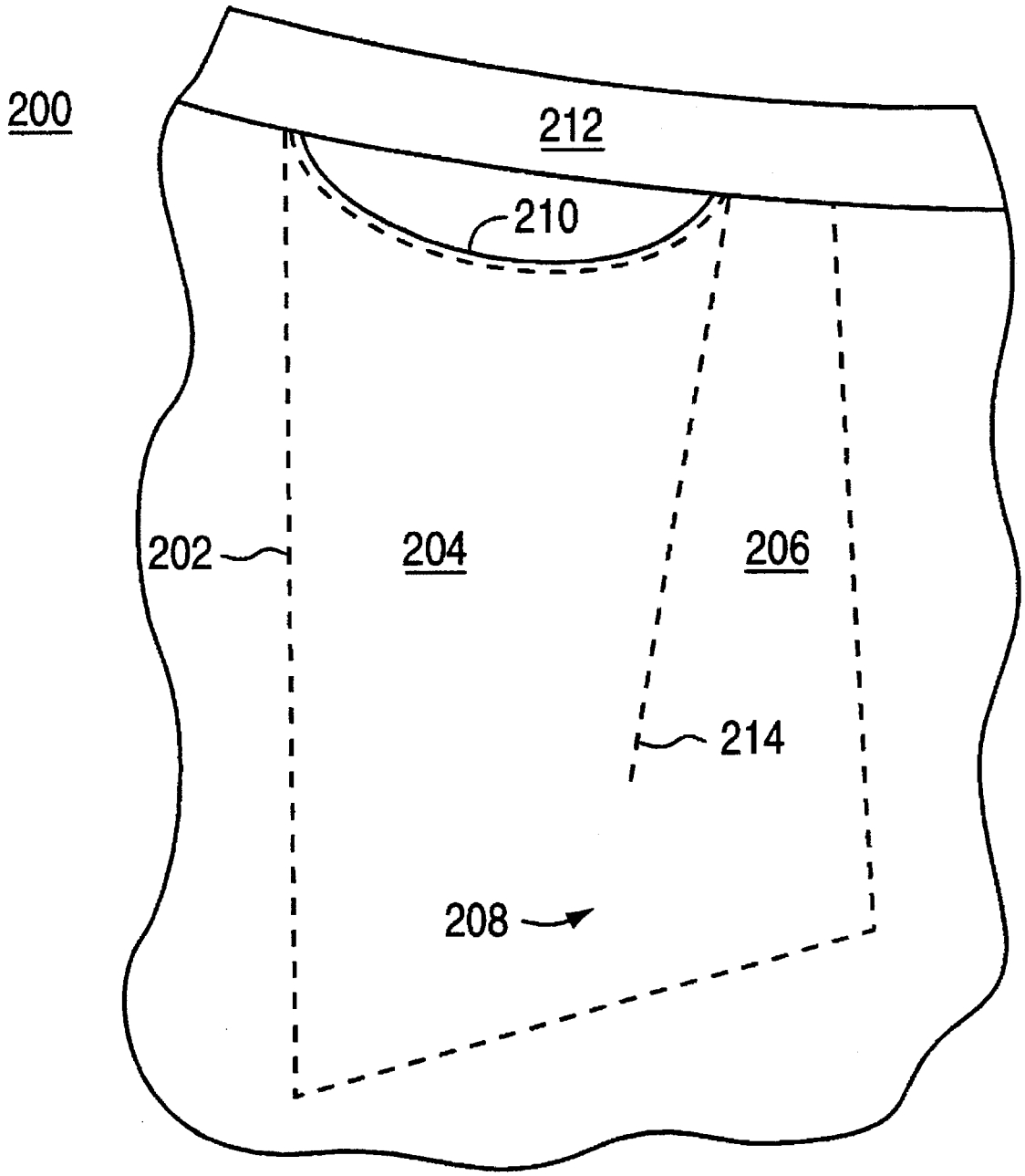
FIG. 10 illustrates yet another embodiment of the present invention wherein the pocket comprises a substantially rectangular shape.

FIG. 10 illustrates another embodiment of the present invention wherein pocket 202 has a substantially rectangular shape. As shown, pocket 202 includes a front compartment 204 and a rear compartment 206 having a passage 208 that permits articles to pass between the two compartments. Compartment 204 includes a pocket opening 210 that is positioned substantially along the waistband 212 of garment 200. In one embodiment compartments 204 and 206 are separated by a stitching 214 sewn through the pocket bag. It is appreciated that in lieu of stitching the pocket bag together to form compartments 204 and 206, any of a number of other attachment methods including Velcro, staples, etc., may also be used.

It will be appreciated by those skilled in the art that the foregoing detailed description of the present invention is no way intended to be limiting and that many modifications can be made to the described construction while remaining within the spirit and scope of the invention.

What is claimed is:

1. A garment having a leg with a front panel and a back panel being joined at a side seam and further having a pocket, said pocket comprising:

a first compartment extending at least partially downward into the leg of said garment, said first compartment having a pocket opening for depositing articles into said first compartment, the articles being maintained in said first compartment as the wearer stands, said pocket opening being located in front of or along said side seam of said garments, said first compartment further comprising a first front edge, a first back edge, and a bottom edge extending forward and downward from a first point behind said pocket opening to a low point at said first front edge; and a second compartment located behind said first compartment, said second compartment having a second front edge, a second back edge and a passage disposed along a bottom portion of said second compartment to permit articles located within said first compartment to pass along said bottom edge of said first compartment into said second compartment through said passage when the wearer sits down or rolls backward.

2. The garment of claim 1 wherein said second compartment has a substantially crescent shape.

* * * * *